US006499902B2

(12) United States Patent
Kuhn

(10) Patent No.: US 6,499,902 B2
(45) Date of Patent: Dec. 31, 2002

(54) WRITING AND METERING DEVICE

(75) Inventor: Martin Kuhn, Fluorn-Winzeln (DE)

(73) Assignee: Schmidt Feintechnik GmbH, St. Georgen/Schwarzwald (DE)

( * ) Notice: Subject to any disclaimer, the term of this patent is extended or adjusted under 35 U.S.C. 154(b) by 0 days.

(21) Appl. No.: 09/987,451

(22) Filed: Nov. 14, 2001

(65) Prior Publication Data

US 2002/0067948 A1 Jun. 6, 2002

(30) Foreign Application Priority Data

Nov. 17, 2000 (DE) ..... 100 57 056

(51) Int. Cl.[7] ..... B43K 5/02
(52) U.S. Cl. ..... 401/224; 401/223
(58) Field of Search ..... 401/224, 223, 401/225, 188, 198

(56) References Cited

U.S. PATENT DOCUMENTS 2,620,774 A * 12/1952 Mustard ..... 401/224
4,556,336 A * 12/1985 Sano et al. ..... 401/224
5,951,187 A * 9/1999 Hsieh ..... 401/225
6,340,262 B1 * 1/2002 Komiya et al. ..... 401/224

FOREIGN PATENT DOCUMENTS

| | | |
|---|---|---|
| DE | 32 07 219 | 10/1983 |
| DE | 41 00 644 | 8/1991 |
| GB | 2 118 486 | 11/1983 |

* cited by examiner

*Primary Examiner*—David J. Walczak
(74) *Attorney, Agent, or Firm*—Nath & Associates PLLC; Gary M. Nath; Harold L. Novick

(57) ABSTRACT

Writing and metering device with an ink supply chamber (22), an ink guide with a capillary ink regulator (20) and with a ventilation channel with a semi-permeable seal (30), a first non-capillary space (28) and a second non-capillary space (33). The second non-caplliary space (33) is connected to the ink supply chamber (22) by at least one capillary **(32*a* and/or 32*b*). To reduce ink losses a labyrinth vent (26)** can additionally be provided in the ventilation channel.

5 Claims, 1 Drawing Sheet

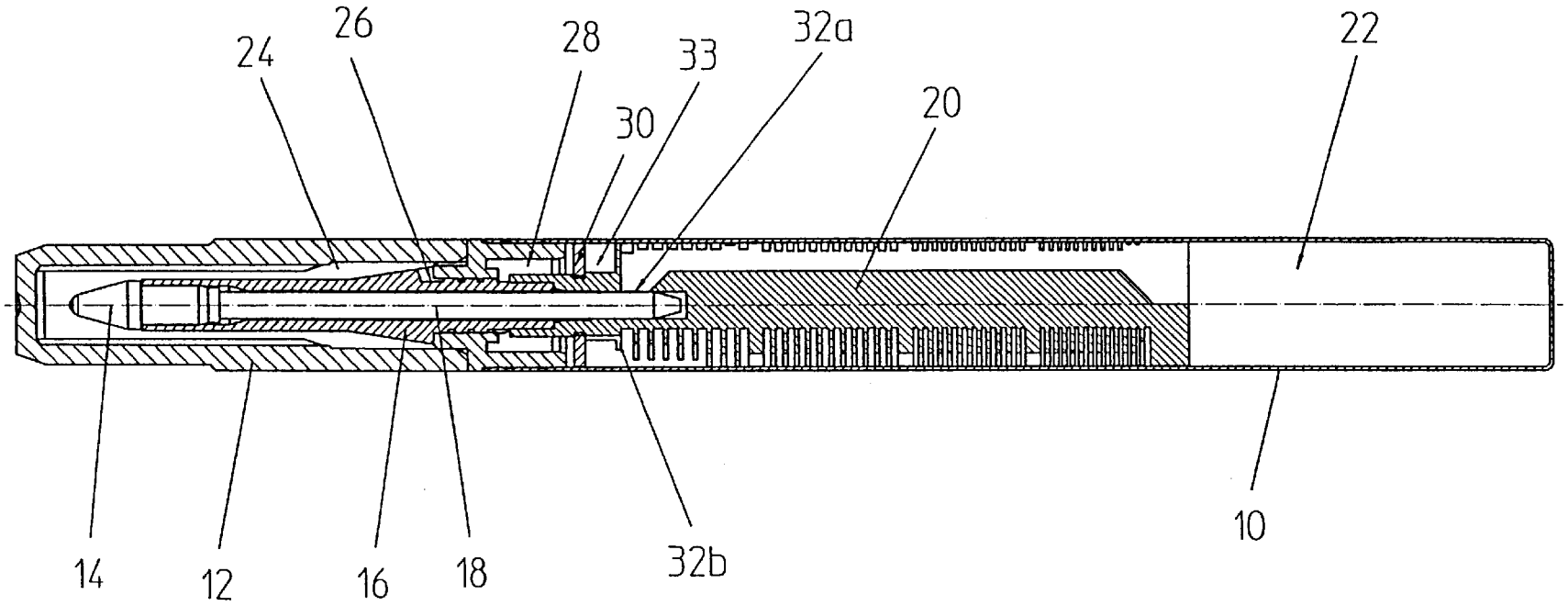
22
20
32a
33
30
28
26
24
10
32b
18
16
12
14

WRITING AND METERING DEVICE

FIELD OF THE INVENTION

This invention relates to a writing and metering device.

BACKGROUND OF THE INVENTION

Such a device is known from Great Britain patent No. GB 2 118 486 A. As disclosed in that patent, a semi-permeable seal and an adjoining non-capillary space at the front end of the ventilation channel are intended to serve as an anti-escape mechanism to prevent the escape of ink. Although the membrane-like seal prevents the escape of ink via the ventilation channel, at this point it cannot prevent ink dripping via the writing tip following one or more large changes in pressure and/or temperature. This is because ink which escapes into the non-capillary space cannot be drawn back into the ink supply chamber. This results in an enclosed volume of air which can lead to leakage when there are large variations in pressure and/or temperature.

A device mentioned at the outset is intended to be improved by the present invention in such a way that ink which has escaped under the influence of pressure and/or temperature is always drawn back into the ink supply chamber and a constant ventilation of the ink supply chamber is guaranteed.

SUMMARY OF THE INVENTION

This object is achieved according to the present invention by a writing and metering device with an ink supply chamber, an ink holder, with a capillary ink regulator, leading from the ink supply chamber to the writing wick, and with a ventilation channel connected to the ink supply chamber, a first non-capillary space and a semi-permeable seal which is impermeable to ink, characterized in that the first non-capillary space and the semi-permeable seal are connected, via a second non-capillary space and the latter via at least one capillary, to the ink supply chamber.

The arrangement of the semi-permeable seal within the writing device as well as of two non-capillary spaces in front of and behind the semi-permeable seal together with at least one capillary channel, or connection, between the hindmost non-capillary space and the ink supply chamber results in unusually good security against leakage of ink. The capillary connection ensures that ink which has escaped behind the semi-permeable seal is drawn back into the ink supply chamber and that a constant ventilation of the ink supply chamber is guaranteed.

A labyrinth vent in the ventilation channel in front of the first non-capillary space and the semi-permeable seal serves additionally to reduce ink losses when the writing device is stored with the cap removed.

BRIEF DESCRIPTION OF THE DRAWING

The invention is described by way of example in more detail using the FIGURE which shows a diagrammatic longitudinal section of a preferred embodiment of the writing and metering device according to the invention.

DETAILED DESCRIPTION OF THE PREFERRED EMBODIMENT

The writing and metering device as shown on the FIGURE has a housing 10 and a cap 12 which can be slipped onto a front end of housing 10. A writing tip 14 is connected, via a holder 16 and a writing wick 18 arranged in the holder 16, to a capillary ink regulator 20 and via said capillary ink regulator 20 to an ink supply chamber 22 arranged at a rear end of the housing 10. The holder 16 is surrounded by a long front ventilation chamber 24 which is connected to the ink chamber 22 by a ventilation channel. Said ventilation channel comprises a labyrinth vent 26 connected to a first non-capillary space 28, an adjoining semi-permeable seal 30 which is impermeable to ink, straddling the ventilation channel and a second non-capillary space 33 separated from the first non-capillary space 28 by the semi-permeable seal 30. The ink regulator 20 is connected to the second non-capillary space 33 via one or more capillary connections 32*a* and/or 32*b* so that any ink which has entered the second non-capillary space 33 is drawn back into the ink supply chamber 22. The labyrinth vent 26 additionally serves to reduce ink losses when the writing device is stored with the cap removed.

What is claimed is:

1. A writing and metering device comprising an ink supply chamber, a writing wick, and a capillary ink regulator leading from the ink supply chamber to the writing wick, and a ventilation channel connected to the ink supply chamber, wherein the ventilation channel is comprised of a first non-capillary space, a second non-capillary space and a semi-permeable seal which is impermeable to ink and separates said first non-capillary space from said second non-capillary space and said second non-capillary space is connected by at least one capillary connection to the ink supply chamber.

2. The writing and metering device according to claim 1, further comprising a labyrinth vent in the ventilation channel connected to said first non-capillary space.

3. A writing and metering device comprising an ink supply chamber, a holder holding a writing wick, a capillary ink regulator leading from the ink supply chamber to the writing wick, and a ventilation channel connected to the ink supply chamber, wherein the ventilation channel further comprises: a labyrinth vent leading to a first non-capillary space, a semi-permeable seal which is impermeable to ink, and a second non-capillary space separated from said first non-capillary space by said semi-permeable seal and being connected, by at least one capillary, to the ink supply chamber.

4. Writing and metering device with an ink supply chamber, an ink holder, with a capillary ink regulator, leading from the ink supply chamber to a writing wick, and a ventilation channel connected to the ink supply chamber, a first non-capillary space and a semi-permeable seal which is impermeable to ink, with the first non-capillary space and the semi-permeable seal being connected via a second non-capillary space and the latter via at least one capillary, to the ink supply chamber and in that a labyrinth vent is provided in the ventilation channel.

5. The writing and metering device according to claim 1, further comprising a holder having an internal space holding said writing wick therein; a vent defined by said holder, and a labyrinth connection in said holder and connecting said vent to said first non-capillary space.

* * * * *